United States Patent [19]

Reardon

[11] Patent Number: 4,943,089

[45] Date of Patent: Jul. 24, 1990

[54] FINGERPRINT SENSITIVE PAD

[76] Inventor: David C. Reardon, 50 Nottingham, Springfield, Ill. 62704

[21] Appl. No.: 352,888

[22] Filed: May 17, 1989

[51] Int. Cl.[5] ..... B42D 15/00

[52] U.S. Cl. ..... 283/81; 118/31.5; 283/68; 283/69; 283/70; 283/78

[58] Field of Search ..... 283/68, 69, 70, 78, 283/115; 428/40, 78, 192, 916; 118/31.5

[56] References Cited

U.S. PATENT DOCUMENTS

| | | | |
|---|---|---|---|
| 1,341,346 | 5/1920 | Smiley | 283/78 |
| 1,536,991 | 5/1925 | Varetoni | 283/69 |
| 1,543,747 | 6/1925 | Brey | 281/15.1 |
| 2,912,259 | 11/1959 | Young | 283/78 |
| 3,447,818 | 6/1969 | Pizzol | 283/68 |
| 3,664,910 | 5/1972 | Hollie | 283/69 |
| 4,669,753 | 6/1987 | Land et al. | 283/115 |

*Primary Examiner*—Paul A. Bell
*Assistant Examiner*—Thomas Hamill, Jr.
*Attorney, Agent, or Firm*—Richard L. Litman

[57] ABSTRACT

A fingerprint sensitive pad is disclosed for affixing a fingerprint to a document. The pad includes a base sheet adhesively attached to the document. The base sheet, which may be reflective, has an adhesive-like coating which receives the fingerprint image when a finger is pressed upon it. The pad has a hinged cover, which removably adheres to the adhesive-like coating to protect the fingerprint image.

5 Claims, 2 Drawing Sheets

Fig 1
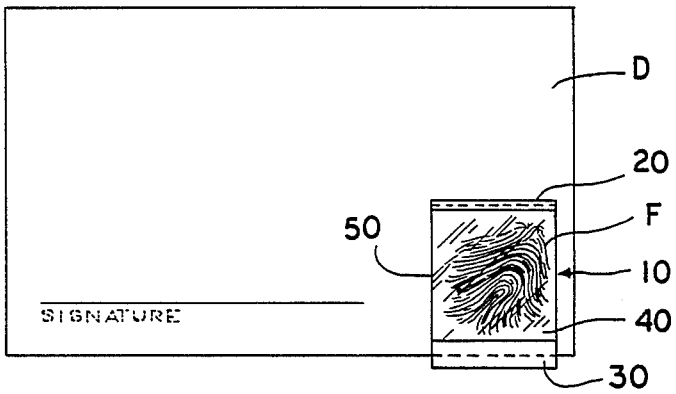
Fig 2
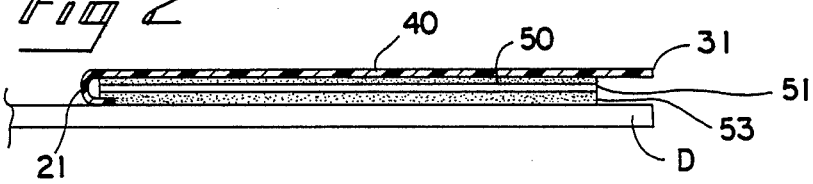
Fig 3
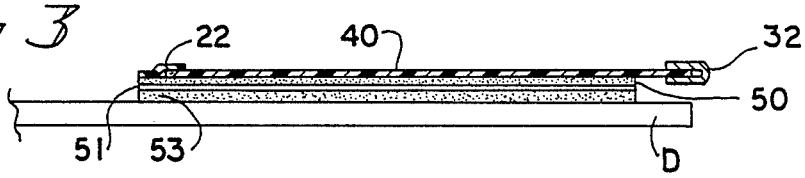
Fig 4
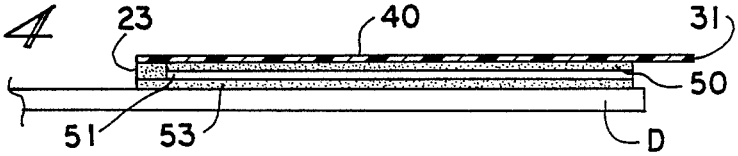
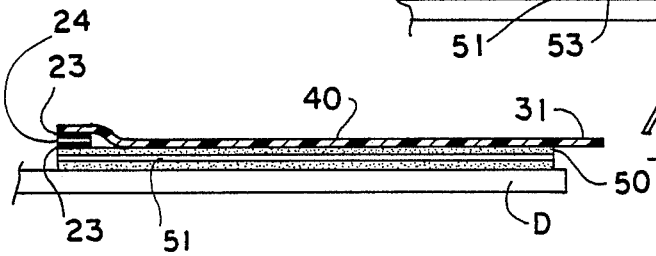
Fig 5
Fig 6
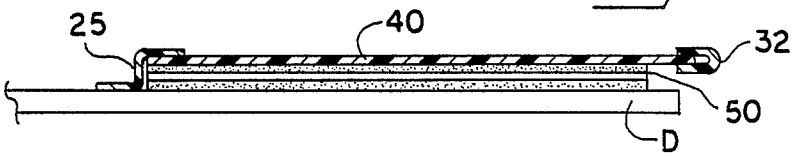
Fig 7
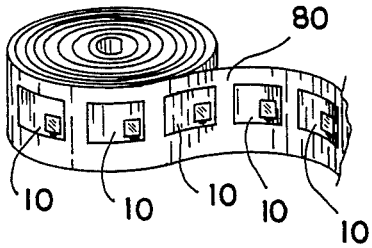
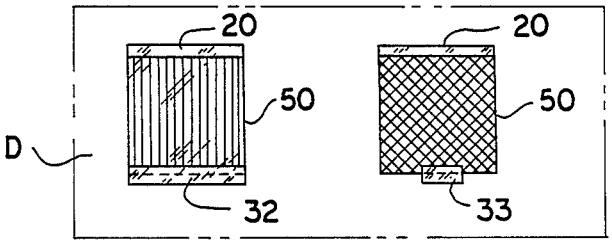
Fig 8

FINGERPRINT SENSITIVE PAD

BACKGROUND OF THE INVENTION

1. Field of the Invention

This invention relates generally to an identification records system comprising a device for obtaining and recording fingerprint data. More particularly, the invention relates to an improved fingerprint device on which a fingerprint can be imprinted and stored for use on documents to permit the positive identification of persons involved in legal and business transactions.

2. Description of the Prior Art

The use of signatures on documents has been the primary means of identification used in legal and business transactions. This well known system of identification has always been plagued by fraud resulting from forgery and misrepresentation of identities. Since it is often difficult or impossible to identify the perpetrator of such fraud by examination of the forged signature alone, apprehension and prosecution of the perpetrators is difficult and must often rely on evidence other than the actual document.

The use of fingerprints in conjunction with signatures, or in the place of signatures, would alleviate the above problems, deter fraud, and provide a permanent record of the identity of the persons involved in the transaction. The taking of fingerprints, however, has previously been a time consuming and messy task involving inks, or in a few cases, a combination of special chemicals and chemically sensitized paper.

Thus the need exists for a clean and rapid method of taking fingerprints for positive identification, and in particular for the use of such a method in financial, legal and business documents in which positive identification of parties is crucial and fraud is deterred.

Various prior art fingerprint devices and the like, are well known and are found to be exemplary of the U.S. prior art. U.S. Pat. No. 2,500,612 to Krough discloses a device for placing fingerprints on documents. This invention includes the use of powder on the finger before the impression is made on a pad. U.S. Pat. No. 3,467,055 to Yonchar teaches a device for preserving fingerprints on a document, which also includes folded strips and the use of a powdery substance. U.S. Pat. No. 3,664,910 to Hollie discloses a document identification system where a stamp-like patch is adhesively attached to a document. After peeling away from the patch a protective liner which must then be thrown away, a fingerprint is impressed on an exposed tacky surface, and a transparent cover sheet is then laid down and adhered to the tacky surface to preserve the print.

These patents or known prior uses teach and disclose various types of fingerprint devices of various sorts and manufactures as well as methods of their construction; but none of them, whether taken singly or in combination, disclose the specific details of the combination in such a way as to bear upon the claims of the present invention.

The present invention is an improvement over the prior art in that it provides a construction which does not soil the user's hand with any powders or chemicals, and which further does not require the peeling and discarding of a backing sheet such as found in Hollie. In addition, the invention provides for a reflective or mirrored substrate which allows greater clarity and ease of viewing of the fingerprint than is found in the prior art.

SUMMARY OF THE INVENTION

An object, advantage and feature of the present invention is to provide a novel fingerprint sensitive pad that is simple and convenient in use, and which is inexpensive to produce.

Another object, advantage, and feature of the invention is to provide a fingerprint sensitive pad which uses a base substrate having a tacky adhesive like surface to receive a fingerprint.

Yet another object, advantage and feature of the invention is to provide a clear flexible cover over the base substrate which protects the fingerprint image while allowing the image to remain visible.

Still another object, advantage, and feature of the invention is to provide a base substrate which is reflective or mirrored to increase the visibility of the fingerprint image.

It is still another object of the present invention to provide a fingerprint sensitive pad that can be affixed to a document. This fingerprint pad can be used as verifiable proof of the identity of the signor. However, the scope of the invention is not limited solely to this use.

These and other objects are accomplished in accordance with the present invention by providing a fingerprint sensitive pad for obtaining and recording latent fingerprints comprising a substrate sheet having a reflective or mirrored surface which contains a layer of inkless imprinting material applied thereon to accept the imprint of a finger, and a flexible protective cover hingedly mounted over the substrate sheet to protect a latent fingerprint impression from degradation and adulteration during storage in a document. The use of the reflective surface creates a mirrorlike image of the fingerprint and allows the print image to be viewed with the naked eye. The flexible protective cover may be lifted for application of the imprint or removed for unobstructed processing of the fingerprint image and then replaced over the substrate to protect the integrity of the latent image when in storage. Since the protective cover is removed during processing of the print image, it allows for the use of other than a clear cover, such as a cover constructed of an opaque material to protect the print against photodegradation and preserve confidentiality.

The fingerprint sensitive pad in accordance with one embodiment of the present invention is adhesively affixed to a document by means of an adhesive backing applied to an opposing surface of the substrate sheet to provide a permanent identification records system. The fingerprint pad of the invention in association with the document, which is generally used in a business or legal transaction and requires a signature and other identification, serves as a means of positive identification should the identity of a transacting party ever be called into question.

These, together with other objects and advantages of the invention, may be more fully appreciated by reference to the following detailed description and accompanying drawings wherein like numerals refer to like elements throughout.

DESCRIPTION OF THE SEVERAL VIEWS OF THE DRAWINGS

FIG. 1 is a top view of a document showing the fingerprint sensitive pad applied thereon.

FIGS. 2 through 6 and 9 are side sectional views of the fingerprint sensitive pad showing different configurations for hinging the clear cover to the imprinting substrate, and showing different lift tabs for the cover.

FIG. 7 is a perspective view of a row of fingerprint sensitive pads removably mounted on a strip of peel-away backing material.

FIG. 8 is a top view of a document showing two possible configurations of the lift tab for the cover of the fingerprint sensitive pad, and showing the imprinting material constructed in patterns rather than as a solid covering.

DETAILED DESCRIPTION OF THE PREFERRED EMBODIMENT

Figure 9:
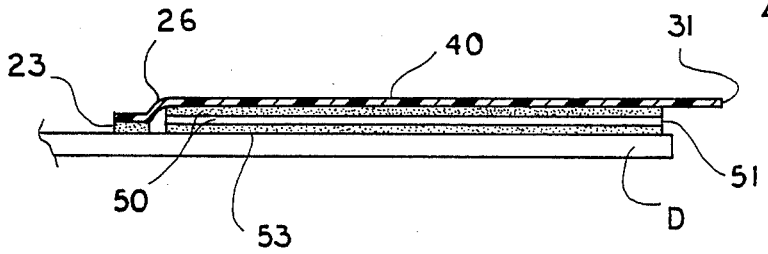

As seen in FIG. 1, the fingerprint sensitive pad 10 is typically mounted on a document D in any convenient location. A fingerprint image F impressed upon a layer of imprinting material 50 here is visible through the flexible protective cover 40. The cover 40 is hinged at one end 20 and may feature a lift tab 30 at the other end. At the time of a transaction such as a purchase, the protective cover 40 is lifted by means of lift tab 30 to expose the adhesive-like layer of imprinting material 50, which is then imprinted with the fingerprint. The cover 40 is then replaced over the fingerprint image F to protect the print from contamination and degradation. The protective cover may be removed by lifting and replaced an indefinite number of times without damaging the integrity of the print.

FIG. 2 shows a section view of one embodiment of the invention. The imprinting material 50 is is applied as a thin coating on the reflective or mirrored surface of substrate sheet 51, which is affixed on its bottom side to the document D by adhesive backing 53. The adhesive backing will typically be adapted to hold the substrate sheet 51 securely to the document D.

The imprinting 50 is typically a transparent or semi-transparent, tacky substance which accepts the imprint of the finger. The use of a tacky, adhesive-like imprinting material serves to hold the cover 40 down to protect the unused pad, or to protect a fingerprint. The tacky, adhesive nature of the imprinting material 50 also serves to hold the finger in place during imprinting, thereby reducing or eliminating the possibility of smudging of the print due to movement of the finger.

The transparent or semi-transparent properties of the imprinting material 50 allow the imprint to be visible against the background of the reflective surface of substrate sheet 51. In a preferred embodiment, the reflective surface of substrate sheet 51 is a mirrorlike surface of polished metallic material, such as metallic mylar, metallic vinyl, or metallic foil. The use of a reflective material for the imprinting surface of the substrate sheet 51 causes a distinct shadow effect, whereby the image impressed on the imprinting material 50 becomes more highly visible.

Also shown in FIG. 2 is the flexible cover 40, which may be constructed of any flexible, transparent material such as plastic, mylar, or cellophane. The cover 40 is hingedly attached by a hinge 21 at one side. The cover 40 is held snugly against the imprinting material 50 by the tacky, adhesive properties of the imprinting material 50. The cover 40 can be peeled away from the imprinting material 50 by lifting a tab portion 31, which extends beyond an edge of the substrate sheet 51 to make lifting of the cover 40 easier. The cover, while generally transparent, may be tinted or polarized in such a way as to increase the contrast or visibility of the imprint.

The cover 40 may be alternately constructed from a flexible opaque material. A fingerprint F protected by such a material will be less likely to fade due to photodegradation. Additionally, a cover 40 composed of an opaque material may provide a confidentiality to the fingerprinting process. The person marking the imprinting material 50 will not feel as though his fingerprint were visible for all to see or copy.

It may be necessary to cover at least part of the undersurface of the flexible cover 40 with a release liner or substance. This release liner will prohibit the irremovable attraction of the flexible cover 40 to the imprinting material 50. The release liner will also serve to keep intact the fingerprint image should the flexible cover 40 need to be removed for any reason.

FIGS. 2, 3, 4, 5, 6, and 9 show sectional views of several different embodiments for the hinges 21, 22, 23, 24, 25 and 26, respectively; and various lift tabs 31 and 32. FIG. 2 shows the hinge 21 consisting of an extended piece of the cover 40 which is folded under the substrate sheet 51, and which is held by the base adhesive 53. FIG. 3 shows the hinge 22 being formed by a piece of tape attached to the top of the edge of cover 40 and to the top of the edge of substrate sheet 51. FIG. 4 shows the cover 40 being held at one edge by a strong adhesive 23. The strong adhesive 23 may be the same type adhesive 53 as used to mount the substrate sheet 51 to the document D. FIG. 5 shows the cover 40 held at one end to the substrate sheet 51 by a member 24 having strong adhesive 23 on both sides. FIG. 6 shows a hinge 25 formed by a piece of tape attached to one edge of cover 40 and to the document D by an adhesive. FIG. 9 shows the cover itself providing the hinged attachment to the document D. In this embodiment, the flexible cover 40 extends beyond the edge of substrate sheet 51 and attaches to the document D by a strong adhesive 23.

In an alternative embodiment of the invention, the document itself may serve as the substrate sheet to further reduce the number of components of the present device and lessen the cost of manufacture. In this particular embodiment which is not shown, a layer of the reflective material may be incorporated directly onto an area of the document reserved for the fingerprint. This may be achieved by applying to the section of the document, a suitable liquid coating material which upon drying creates a reflective surface which directly adheres to the document. A layer of imprinting material is then applied over this reflective section, with the cover hingedly attached to the document by any one of the means previously described. This unique construction eliminates the need for the substrate sheet and the contiguous layer of adhesive backing.

In FIGS. 2, 4, and 5, the lift tab 30 is provided by an overlapping portion 31 of cover 40. In FIGS. 3 and 6 the lift tab 32 includes an extra piece of material wrapped around the edge of cover 40.

FIG. 8 shows that the lift tab 32 may extend across the width of the cover 40, or the lift tab 33 may extend only partially across cover 40. FIG. 8 also shows that the imprinting material 50 may be uniformly applied over the reflective surface of substrate sheet 51, the adhesive-like imprinting material may also be applied in any pattern, such as a parallel line or cross-hatch pattern. In this type of embodiment, the fingerprint consists of an pattern left by the oils from the fingers on the substrate sheet 51. The adhesive like imprinting material in this embodiment serves primarily only to prevent finger movement and smudging as well as holding the flexible cover 40 in place.

The fingerprint sensitive pads may be manufactured individually with a peel off backing (not shown) covering the base adhesive 53. Alternatively, as shown in FIG. 7, the invention may be produced on a roll of peel off material 80. Alternatively, the invention may be mounted directly on the documents during manufacture. Other methods of manufacture and mounting should be obvious to those skilled in the art.

The foregoing is considered as illustrative only of the principles of the invention. Further, since numerous modifications and changes will occur to those skilled in the art, it is not desired to limit the invention to the exact construction shown and described, and accordingly, all suitable modifications, and equivalents which may be resorted to fall within the scope of the invention.

I claim:

1. A fingerprint sensitive pad for imprinting and storing a fingerprint image on a document, comprising:

a substrate sheet having a reflective surface and an opposing surface;

a layer of inkless imprinting material applied to said reflective surface of the substrate sheet to receive an imprint of a finger;

a flexible protective cover hingedly mounted along an edge of said substrate sheet to protect a latent fingerprint image from degradation and adulteration during storage; and a layer of adhesive backing on said opposing surface of the substrate sheet to secure the fingerprint sensitive pad to a document, wherein the document in association with said fingerprint sensitive pad provides an identification records system for positively identifying a person involved in a transaction.

2. The fingerprint sensitive pad according to claim 1 wherein said flexible protective cover comprises of opaque material to protect the latent fingerprint image from photodegradation and to preserve confidentiality of the person involved in the transaction.

3. The fingerprint sensitive pad according to claim 1 wherein said flexible protective cover comprises a transparent material.

4. The fingerprint sensitive pad according to claim 1 wherein said layer of inkless imprinting material consists of a thin coating of a transparent tacky substance.

5. The fingerprint sensitive pad according to claim 1 wherein said substrate sheet having a reflective surface consists of a sheet of polished metallic material having a mirrorlike surface.

* * * * *